United States Patent [19]

Friedman

[11] Patent Number: 4,903,360

[45] Date of Patent: Feb. 27, 1990

[54] ARTICLE OF BEDDING

[75] Inventor: Aviyam Z. Friedman, Montreal, Canada

[73] Assignee: Med-I-Pant Inc., Montreal, Canada

[21] Appl. No.: 261,328

[22] Filed: Oct. 24, 1988

[30] Foreign Application Priority Data

Aug. 17, 1988 [CA] Canada ..... 575002

[51] Int. Cl.[4] ..... A47G 9/02

[52] U.S. Cl. ..... 5/485; 5/494; 5/497

[58] Field of Search ..... 5/494, 497, 485, 486, 5/482, 490

[56] References Cited

U.S. PATENT DOCUMENTS

| | | | |
|---|---|---|---|
| 768,119 | 8/1904 | Fine | 5/482 |
| 2,679,056 | 5/1954 | Simpson | 5/485 |
| 2,695,414 | 11/1954 | Ford et al. | 5/485 |
| 2,772,425 | 12/1956 | Brodie | 5/485 |
| 4,021,869 | 5/1972 | Root | 5/485 X |
| 4,273,380 | 6/1981 | Silvestri | 5/482 X |
| 4,308,626 | 1/1982 | Weiss | 5/485 |
| 4,680,821 | 7/1987 | Maguire | 5/485 X |

FOREIGN PATENT DOCUMENTS

| | | |
|---|---|---|
| 234454 | 9/1923 | Canada . |
| 782958 | 4/1968 | Canada . |

*Primary Examiner*—Michael F. Trettel

*Attorney, Agent, or Firm*—McFadden, Fincham, Marcus & Allen

[57] ABSTRACT

An article of bedding, such as a bedsheet, bedspread, blanket, or the like, provides additional fabric for a user's feet by means of a pleat formed by a pair of oppositely-folded parallel folds extending across the width of the article. In preferred embodiments, the folds of material forming the pleat are seamed together only at the ends of the pleat so that the medial parts of the pleat can unfold during use. The seams will hold the pleat in place so that when the bed is unoccupied, the folds will lie flat, especially if pressed. The seams may be arranged to coincide with the upper edge of the mattress and, between the seams and the side edges of the mattress, fabric equivalent to two of the three layers of the pleat may be removed to give a flat valance portion.

10 Claims, 1 Drawing Sheet

ARTICLE OF BEDDING

This invention relates to articles of bedding in particular to bedsheets, bedspreads, blankets and the like.

BACKGROUND OF THE INVENTION

It is sometimes desirable for bedsheets and other top bedding, such as blankets, bedspreads, and the like, to provide additional fabric in the area of for example the user's feet.

Various proposals have been made in the prior art for sheet construction to arrange the configuration of the sheet into a desired form. Depending on the nature of the prior art proposal the sheet construction will provide an expandable sheet for different purposes. By way of example, U.S. Pat. No. 2,567,072 to Kay discloses a tubular sheet which fits over a mattress in an "envelope" fashion. U.S. Pat. No. 2,636,191 to Bate discloses a sheet which can be folded to serve as both upper and lower sheets for a narrow bed. U.S. Pat. No. 2,637,860 to Lehigh discloses a compound bed covering. Different layers are sewn together using double-folded edges. U.S. Pat. No. 2,895,146 to Lester discloses a reversible cover for pillows, mattresses or the like. U.S. Pat. No. 3,331,088 to Marquette discloses a blanket with separate panels which can be attached or detached to increase or decrease the thickness and hence the warmth. Special foot panels can have double oppositely-folded pleats but these are not part of the blanket itself. U.S. Pat. No. 3,377,636 to Addario discloses a bedsheet that has cutouts and guidelines enabling pleats to be formed when the bed is being made. The pleats can run longitudinally or transversely. Because the pleats are formed during bedmaking, there is nothing to secure them in place. U.S. Pat. No. 4,045,831 to Clark discloses an "envelope" bedsheet which can be used as either a top sheet or a bottom sheet. It has pockets at the ends but no expansion pleats. U.S. Pat. No. 4,266,308 to Shatz discloses a bottom sheet/top sheet combination, the bottom sheet pocketed to receive a mattress and the top sheet connected to the bottom sheet to a bottom edge and corners. It has no pleats. U.S. Pat. No. 4,546,508 to Ison discloses both a sheet and a blanket with longitudinal pleats which can unfold to provide room for the occupant. There are no transverse pleats. U.S. Pat. No. 2,525,713 to North discloses a sleeping bag for infants and small children.

None of the above references disclose a simple easily constructed pleat extending across the sheet which is adapted to function as a toe pleat and provide expansion capabilities, similar to the sheets of the present invention.

It is desirable, for different uses, to be able to provide a bedsheet or the like with additional sheet material in the bottom or foot area of the sheet and at the same time to be able to arrange the excess material in a very neat manner where it the structure is not likely to be caught by the user when the sheet is in use.

SUMMARY OF THE INVENTION

According to the present invention, an article of bedding such as a bedsheet, bedspread, blanket or the like, comprises a pleat formed by a pair of oppositely-folded parallel folds extending across the width of said bedsheet or the like, intermediate its ends. The ends of the pleat are secured together by suitable means, conveniently by lateral seams extending in the direction of the length of the bedsheet, or the like, with the medial parts of the pleats unsecured. Preferably, such lateral seams are spaced apart by a distance that corresponds to the width of the mattress to be covered, such that, in use, each lateral seam coincides with or is proximate to the top edge of the underlying mattress.

Preferably, the fold that would be uppermost in use is closer to the head of the article than the fold that would be lowermost in use i.e., closer to the mattress. This ensures, advantageously, that the user's feet can move down the bed without snagging in the pleat.

The bedsheet or the like may have its bottom end fitted, i.e., formed in the shape of a box or pocket to fit snugly over the bottom end of a mattress.

In order to improve the appearance of the bedsheet or the like, the excess material, i.e., equivalent to two layers of the pleat, between the lateral seams and the side edge of the bedsheet, may be removed. Then a transverse line of stitching running between each of the lateral seams and its corresponding neighbouring edge of the bedsheet or the like would join the cut edges enabling the lateral or valance portions of the bedsheet to lie flat. Optionally, if desired the pleat may be pressed. Actually, with the structure of the present invention, the bedding article is such that the design encourages or coerces the pleat to be easily formed and in a "natural" manner with minimum handling and/or tucking.

The sheet material forming a product of this invention can be made of any suitable conventional material, normally employed for this purpose; likewise, the stitches may be of any conventional configuration and may be made by employing conventional equipment. Applicants products can be constructed in different sizes and different lengths or depths of the pleat may be provided for depending on the size of the bed or the like that it is intended to cover. Thus, for example, the pleat may have a depth ranging from 1 or 2 inches, to e.g. 8 or 10 inches or more.

An embodiment of the invention will now be described, by way of example only, with reference to the accompanying drawings in which:

SPECIFIC DESCRIPTION OF A PREFERRED EMBODIMENT

Figure 1:
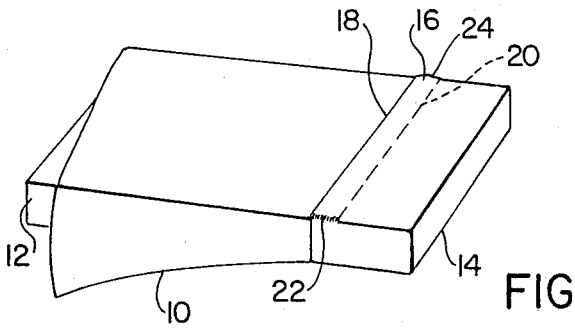
FIG. 1 is a top perspective view of a semi-fitted bedsheet.

Referring now to FIG. 1, a semi-fitted bed linen article in the form of a top bedsheet 10 is shown upon a mattress 12. Although reference in the drawing is made to a bedsheet 12, it will be understood that this is equally applicable to other embodiments of the invention in the form of a bedspread, bottom sheet or blanket. The bottom or foot end 14 of the bedsheet 10, shown at the right hand end in FIG. 1, is stitched and seamed into the shape of a box or pocket so as to fit snugly onto the end of the mattress. The other end of the bedsheet is plain—hence the name "semi-fitted".

Figure 2:
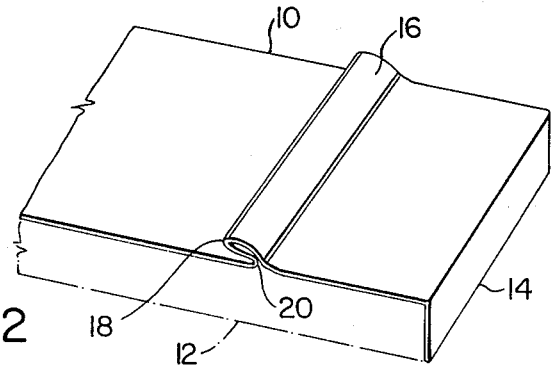
FIG. 2 is a cut-away view corresponding to FIG. 1.

About one third (although this may vary depending on different factors) of the distance from the foot of the bedsheet 10, a pleat 16 extends across a major part of the width of the bedsheet 10. As can be seen in FIG. 2, the pleat 16 is formed by two opposed-folded, parallel folds 18 and 20, respectively. Fold 18, which is uppermost when the bedsheet is fitted to the mattress 12, is closer to the head end of the top bedsheet 10 than is fold 20, which is lowermost facing the mattress 12. This allows the user's feet to move down the bed without snagging in the pleat 16.

The pleat 16 is held in place by seams 22 and 24, which extend one across each end of the pleat 16. Each of the seams 22 and 24 holds together the three layers of material between the two folds 18 and 20, respectively. As can be seen from FIG. 1, the spacing between the seams 22 and 24 is more or less equal to the width of the mattress 12 so that they will coincide with the respective edges of the underlying mattress 12. It will be understood that this can vary, of course. This leads to a neat appearance since the pleat 16 will lie flat when not in use. Because the medial parts of the pleat 16 are not stitched together they can unfold when the bed is occupied. The extra fabric thus available will give added comfort to the occupant, yet the seaming of the ends of the pleat 16 will help it to lie flat when the bed is unoccupied.

Figure 3:
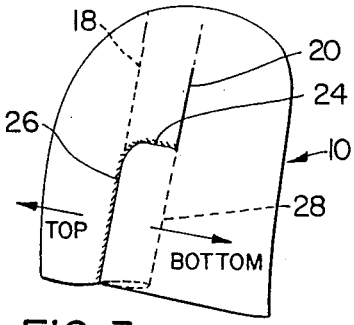
FIG. 3 is a detail top view of a bedsheet in which the pleat stops short of the lateral edges.
Figure 4:
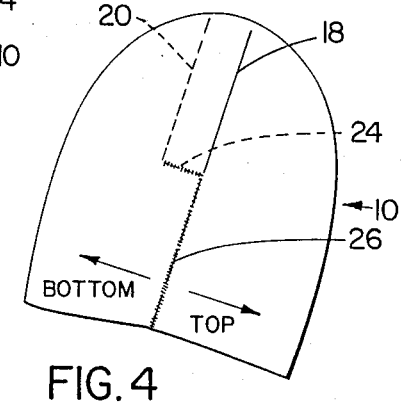
FIG. 4 is a detail underside view corresponding to the view of FIG. 3.

Referring now to FIG. 3, which is a detail view of the underside of the bedsheet 10 of one form of one embodiment of the invention, a line of overlock stitching 26 extends between one end of the seam 24 and the edge of the bedsheet 10 along the line of fold 18 so as to fasten the three layers of material together. The fold of material 28 bounded by the "L" shaped seaming 24, 26 is cut out in this particular embodiment leaving a single thickness of valance fabric to overhang the mattress 12. As can be seen from FIG. 4, only the seams 24 and 26, and the edge of fold 18 are visible.

It will be understood that various modifications can be made to the above described embodiments as will be evident to those skilled in this art upon reading the present disclosure; for example, referring to FIG. 1, the upper portion illustrated at the bottom of FIG. 1 can be constructed so as to be deeper/longer to aesthetically cover or hide the mattress or other bedding items as an optional feature.

I claim:

1. An article of bedding, comprising a bedsheet or similar member, having opposed ends and opposed side edges, and having a pleat formed by a pair of oppositely-folded substantially parallel folds extending across the member intermediate said opposed ends, said folds forming said pleat being secured together by lateral seams, one adjacent each end of said pleat, and wherein that one of said parallel folds which would be uppermost in use is closer to a head-end of the member than the other of said parallel folds, and a pair of transverse seams extending one from each of the lateral seams to adjacent side edges of said member, each of said transverse seams joining said opposed lateral seams to edges of said member following removal from between said lateral seams and said adjacent side edges of said member equivalent to two webs of the pleat.

2. The article of claim 1, wherein each lateral seam extends across the pleat, between the parallel folds.

3. The article of claim 1, wherein the bedsheet or the like has a fitted bottom end.

4. The article of claim 1, wherein said article is a bedsheet.

5. The article of claim 1, wherein said article is a bedspread or a blanket.

6. An article of bedding, comprising a bedsheet or similar member, having opposed ends and opposed side edges, one of said ends being fitted, and having a pleat formed by a pair of oppositely-folded substantially parallel folds extending across the member intermediate said opposed ends, said folds forming said pleat being secured together by lateral seams, one adjacent each end of said pleat, and wherein that one of said parallel folds which would be uppermost in use is closer to a head-end of the member than the other of said parallel folds, said member including a top portion for overlying a mattress and opposite side portions for extending down on either side of said mattress, lateral seams extending across said pleat normal to said folds at the junction between said top portion and at each side portion, and a pair of transverse seams extending one from each of the lateral seams to adjacent side edges of said member, each of said transverse seams joining said opposed lateral seams to edges of said member following removal from between said lateral seams and said adjacent side edges of said member equivalent to two webs of the pleat, said transverse seams cooperating with said fitted end to maintain said member in a flat smooth form.

7. The article of claim 6, wherein each lateral seam extends across the pleat, between the parallel folds.

8. The article of claim 6, wherein the bedsheet or the like has a fitted bottom end.

9. The article of claim 6, wherein said article is a bedsheet.

10. The article of claim 6, wherein said article is a bedspread or a blanket.

* * * * *